United States Patent [19]

Lepage et al.

[11] Patent Number: 5,069,324

[45] Date of Patent: Dec. 3, 1991

[54] CHAIN LOCK FOR CARTS

[76] Inventors: Jean-Paul Lepage, 152, rang d'Argenteuil, Saint-Damase, Province of Quebec, Canada, J0H 1J0; Robert Lepage, 332 Pierre Coté, Bois-des-Filion, Province of Quebec, Canada, J6Z 4A2

[21] Appl. No.: 512,803

[22] Filed: Apr. 23, 1990

[51] Int. Cl.[5] ..... G07F 5/02; G07F 17/00

[52] U.S. Cl. ..... 194/212; 194/905

[58] Field of Search ..... 194/212, 905

[56] References Cited

U.S. PATENT DOCUMENTS

| | | | |
|---|---|---|---|
| 4,474,280 | 10/1984 | Lenander | 194/905 X |
| 4,691,816 | 9/1987 | Trubiano | 194/905 X |
| 4,766,989 | 8/1988 | Maloeuvre et al. | 194/905 X |
| 4,941,560 | 7/1990 | Bailey | 194/905 X |

*Primary Examiner*—F. J. Bartuska

*Attorney, Agent, or Firm*—Pierre Lesperance

[57] ABSTRACT

The device comprises a housing attachable to the handle bar of a nestable cart, such as a shopping cart. The housing has a front and a back key slot, each for receiving a key. Key locking members are mounted in the housing, each associated with a key slot. These locking members are interconnected by a position-inverting mechanism, so that when one locking member is in a key-locking and retaining position, the other locking member is in a key-releasing position, and vice versa. A key is attached to each housing by means of a flexible link, such as a chain, long enough to be inserted into the back key slot of the housing of the next nested cart. However the flexible link can be longer than this requirement. The keys are retained in their back key slots and thus the carts are interlocked in a nested position. The key of the frontmost cart is used to unlock the latter. The front key slot is associated with a coin-receiving slot and a coin-actuated locking member release retains the locking member of the front key slot in key releasing position. Upon insertion of a coin in the coin slot and also of the key of the frontmost cart within its front key slot, said last-named key is retained in the housing of the frontmost cart and the key of the next cart is released from the same housing, whereby the frontmost cart is released for use; it must be returned to the row of shopping carts and the key of the next cart again reinserted into the back key slot of the returned cart to obtain release of the key of the returned cart and of the coin trapped in its housing.

13 Claims, 5 Drawing Sheets

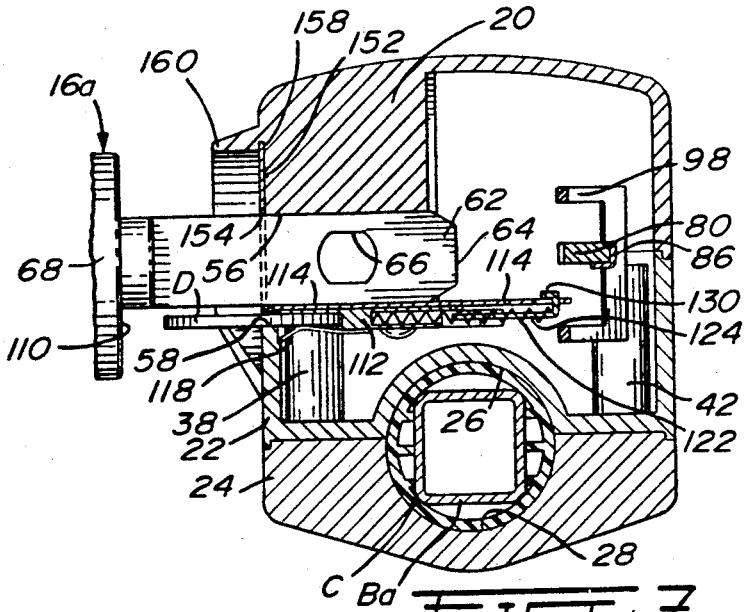
FIG. 7
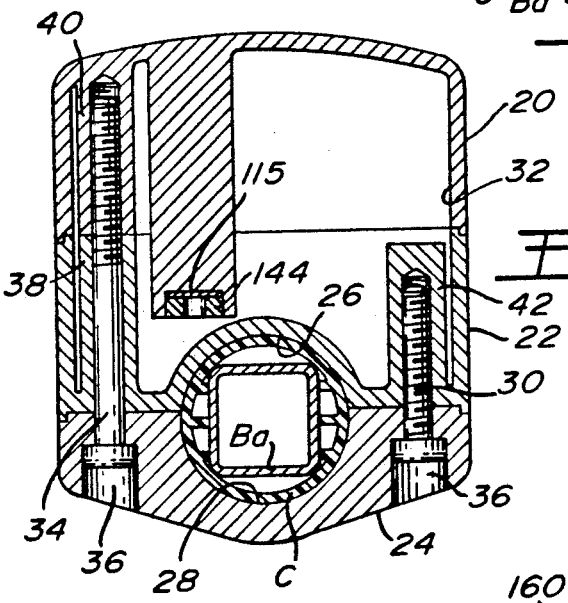
FIG. 8
FIG. 9
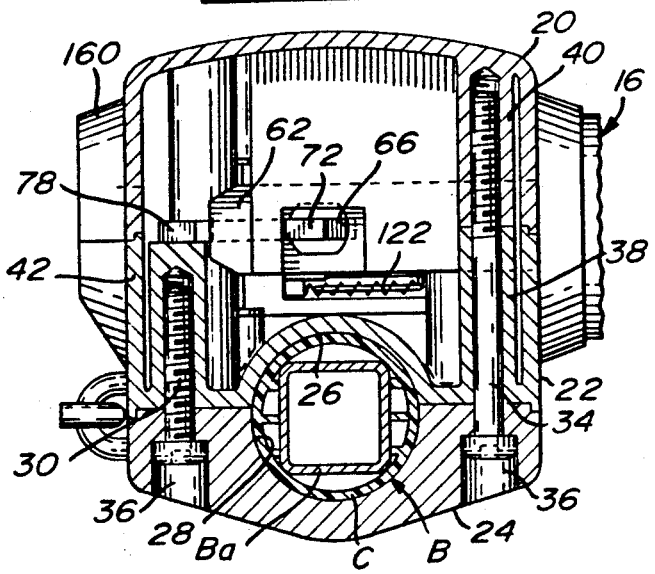

CHAIN LOCK FOR CARTS

FIELD OF THE INVENTION

The present invention relates to a locking device for interlocking at least two nestable carts in nested position.

BACKGROUND OF THE INVENTION

Canadian Patent No 1,241,211 dated Aug. 30, 1988 entitled: "LOCKING DEVICE FOR INTERLOCKING NESTED SHOPPING CARTS", inventor Antoine Truliano, describes a housing attachable to the handle bar of a shopping cart and provided with a locking mechanism to retain a key inserted in a key slot of the housing. To unlock the key, a coin must be inserted in a coin-receiving actuator, which is pushed inside the housing, thereby retaining the coin therein. The key is attached by a flexible link, such as a chain, to the housing of an adjacent cart, so that several carts can be retained interlocked in nested position. A disadvantage of this interlocking system resides in the fact that the effective length of the chain attaching the key to a housing must be shorter than that required to permit insertion in the key slot of the same housing of the key attached to latter. If the chain was long enough to permit this key insertion, then it would be possible for the shopper to retrieve the coin inserted in the housing by simply inserting the key carried by the housing of his cart into the key slot of this housing, thus avoiding having to return the cart to the row of nested carts for the insertion of the key of the next cart for coin retrieval and locking of the just-returned cart to the next cart. Therefore, the distance between the handle bars of nested carts must be somewhat less than the above defined maximum length of the key chain. This is not always possible to obtain because due to the large tolerances allowed in their construction, carts even of the same make do not always nest to the same extent. Also it has been found that the distance between the handle bars of nested carts of various makes can vary between 9" and 18". It follows that the same model of locking device in accordance with the patent cannot be used for different makes of nestable carts.

Another problem resides in the fact that the key freely hangs from the housing attached to the cart being used, and this key can be a source of accidents especially for children. A holder is provided for retaining the free key, but this is not always used.

Another disadvantage of the patented device resides in the complexity of its mechanism.

OBJECTS OF THE INVENTION

The main object of the invention is to provide a device for interlocking nestable carts which obviates the above-noted disadvantages and, more specifically, in that it can accommodate any length of flexible link for attaching the key to the housing or to the cart associated with the key.

Another object of the invention is to provide a locking device of the character described, in which the number of component parts has been considerably reduced with respect to the above-noted patented locking device.

Another object of the present invention is to provide a locking device of the character described, in which both a coin and the key carried by the cart to be used have to be inserted and locked into the housing to release the cart from the other carts of the row and, thus, no key can dangle from the housing of the cart being used and also this locked key cannot be used to effect release of a coin from the housing of a stranded cart.

Another object of the invention is to provide a locking device in which the locked key of the cart being used also serves to trap the coin.

SUMMARY OF THE INVENTION

The locking device of the invention is designed for interlocking a first and a second cart and comprises a first and a second key attachable to said first and second carts, respectively; a housing attachable to said first cart and having a first and a second key slot for receiving said first and second keys, respectively, a two-state locking mechanism, mounted in said housing, including a first and a second locking member associated with said first and second key slots and each movable from a key-releasing position to a key-locking position upon key insertion in the associated slot and locking members interconnecting and position-inverting means; the first and second locking members being in key-locking and key-releasing position, respectively in the first state of said locking mechanism, and in key-releasing position and key-locking position, respectively, in the second state of said locking mechanism, whereby, with said second key locked within said second key slot by said second locking member, insertion of said first key within said first key slot causes locking of said first key to said housing and release of said second key from said housing.

The locking device further includes a coin-receiving cavity in the housing; a coin feeler detecting the presence or absence of a coin in the cavity and a retainer movably mounted in the housing and controlled by the feeler for retaining the first locking member in key-releasing position upon said feeler detecting the absence of a coin in said cavity and for freeing said first locking member for movement to said key-locking position upon said feeler detecting the presence of a coin in the cavity. The key shafts of the keys are substantially identical, so that they can actuate either one of the locking members when inserted in the respective key slots. Each key is preferably attached to the housing by a flexible link. The link is long enough to permit the key of one housing to be inserted into the second slot of the housing of the adjacent nested cart.

Each key includes a head laterally protruding from its key shaft and the coin-receiving cavity is located close to the first key slot, so as to be concealed by the key head of the key inserted into the first key slot. Thus, a coin partially inserted into the cavity is fully pushed thereinto by the key head upon key insertion into the key slot and is concealed by said key head. Preferably, each key has a key shaft with a free end and an opening spaced from the free end, and each locking member is C-shaped and pivoted within the housing to a position in which the outer leg of the C is in the path of the key shaft when inserted in said slot, while the inner leg clears said path, and upon pivoting of said C-shaped locking member to a second position by the key shaft pushing on the outer leg, the inner leg enters said opening and locks the key to the housing. Preferably, the inverting means includes spring-biased toggle levers respectively fixed to the two C-shaped locking members and cause pivoting of one locking member in one direction and retention of the latter in the new position upon pivoting of the other locking member in the opposite direction. Preferably, shock absorbing means are provided in the flexible link attaching the key to its housing to prevent breakage of said link or of its connection to the housing when subjected to a sudden and important pull. Preferably, the housing is made in three parts, two parts adapted to surround and be permanently fixed to the handle bar of a cart, while the third part, which contains the complete locking mechanism, is detachably secured to the other two parts, whereby it can be detached for servicing of the locking mechanism without having to detach the entire housing from the handle bar.

BRIEF DESCRIPTION OF THE DRAWINGS

In the annexed drawings:

FIGS. 7, 8 and 9 are cross-sections taken along lines 7—7, 8—8, and 9—9 of FIG. 5, respectively;

In the various figures, like reference characters indicate like elements throughout.

DETAILED DESCRIPTION OF THE PREFERRED EMBODIMENT

Figures 1, 2:
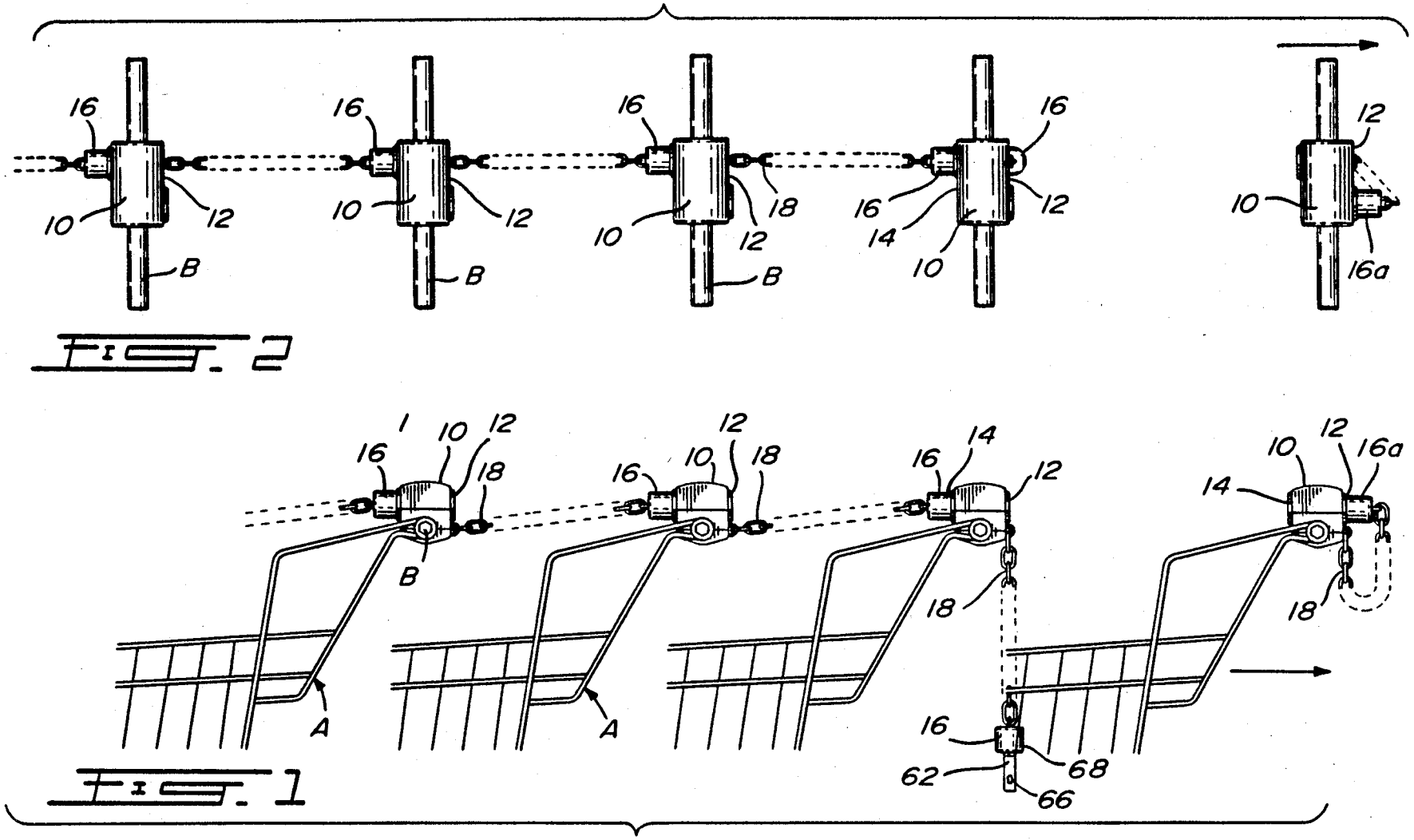
FIG. 1 is a partial side elevation of several internested carts interlocked by the system of the invention, except the last or frontmost cart of the row which has just been released for use.
FIG. 2 is a top plan view of a portion of the handle bars and interlocking mechanisms corresponding to FIG. 1.
Figure 3:
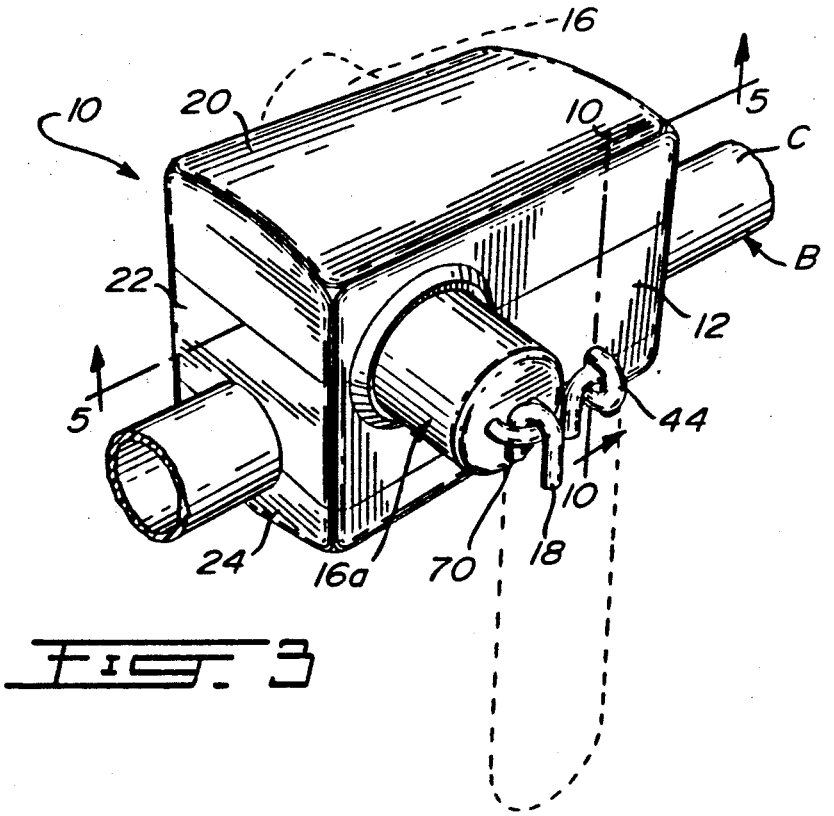
FIG. 3 is a perspective view showing the housing attached to a portion of the handle bar of a cart being used, the key attached to the housing being inserted into its key slot.

Referring to FIGS. 1 and 2, there are shown shopping carts A of a nestable type, each having a handle bar B to which is fixed a housing 10 of the locking device in accordance with the invention. The housing 10 has a front face 12 and a back face 14, each provided with a key slot for receiving a key 16. Key 16 is attached to the housing 10 at the front face thereof by means of a flexible link, such as a chain 18.

As will be explained hereinafter, the housing 10 contains a locking mechanism which retains the key inserted in the housing key slot at the back face 14, this locking mechanism requiring the insertion of a coin and also of the free key 16*a* of the last or frontmost cart of the row of nested carts into the key slot at the front face 12 of the housing for release of the key inserted at the back face, so that the frontmost cart can be used. The front face key 16*a* cannot released and the coin retrieved until the cart is returned and the key from the new frontmost nested cart inserted within the key slot at the back face 14 of the returned cart.

The chain 18 of the backmost key 16 is normally attached to a fixed structure.

Housing 10 is made in three parts, as shown in FIG. 3, 4 and 7 to 11, namely: a top part 20, an intermediate part 22, and a bottom part 24. The three parts are preferably made of cast or molded material and form a housing, of generally rectangular shape when assembled. The intermediate part 22 and bottom part 24 are provided with partly cylindrical channels 26, 28 respectively, which register one with the other when the two parts are assembled by a pair of shorter bolts 30 located at diagonally-opposed corners of the housing. The registering partly cylindrical channels 26, 28 tightly fit around the conventional cylindrical plastic sheath C surrounding the metallic part Ba of handle bar B of the shopping cart A. The intermediate part 22 opens within the bottom opening 32 of the top part 20. The top part carries all of the locking mechanism and the latter partly extends within the intermediate housing part 22. The top part 20 is secured to the intermediate part 22 by means of a pair of longer bolts 34 disposed at the remaining two diagonally-arranged corners of the housing. The longer bolts 34, together with the shorter bolts 30, have their heads accessible through bores 36 opening at the bottom face of the bottom part 24. The longer bolts 34 freely extends through a cylindrical sheath 38 integrally cast within the intermediate part 22 and are threaded within a sheath 40 of upper part 20. Similarly, the intermediate part 22 is provided with diagonally-disposed threaded sheaths 42 in which shorter bolts 30 are screwed. With this arrangement, it is clear that for servicing the locking mechanism contained in the top part 20, only the long bolts 34 have to be removed to detach the top housing part 20. Therefore, the intermediate and bottom parts of the housing can remain in adjusted position fixed to the handle bar.

Figure 10:
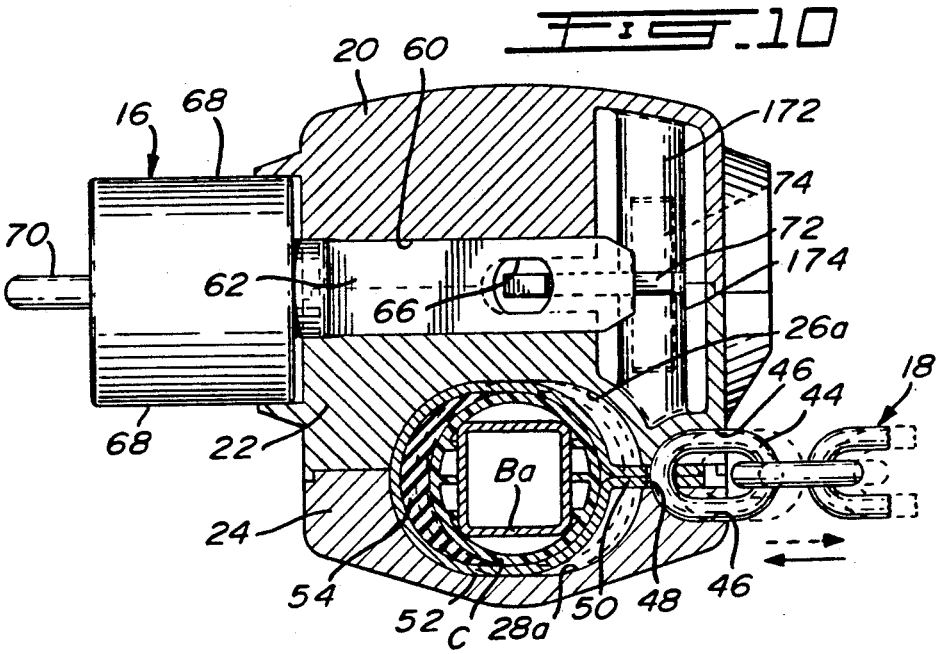
FIG. 10 is a vertical cross-section taken along line 10—10 of FIG. 3.

FIG. 10 shows how the key chain 18 is attached to the housing by a shock absorbing means. The last link 44 of the key chain 18 partially freely enters a pair of registering slots 46 formed at the junction of the intermediate part 22 and bottom part 24, as shown also in FIG. 4. The last link 44 is free to move in or out of the slots 46. This last link freely extends through registering holes 48 made through the arms 50 of a split elongated ring 52, which surrounds the plastic sheath C of the handle bar and also a rubber shim 54 located opposite link 44. Shim 54 acts as a shock-absorber to prevent chain or split ring breakage should a sudden pull be exerted thereon for instance when someone tries to yank the cart retained by the chain through its key.

Channels 26, 28 are transversely elongated as shown at 26*a*, 28*a* to accomodate lateral shifting of split ring 52.

Figure 4:
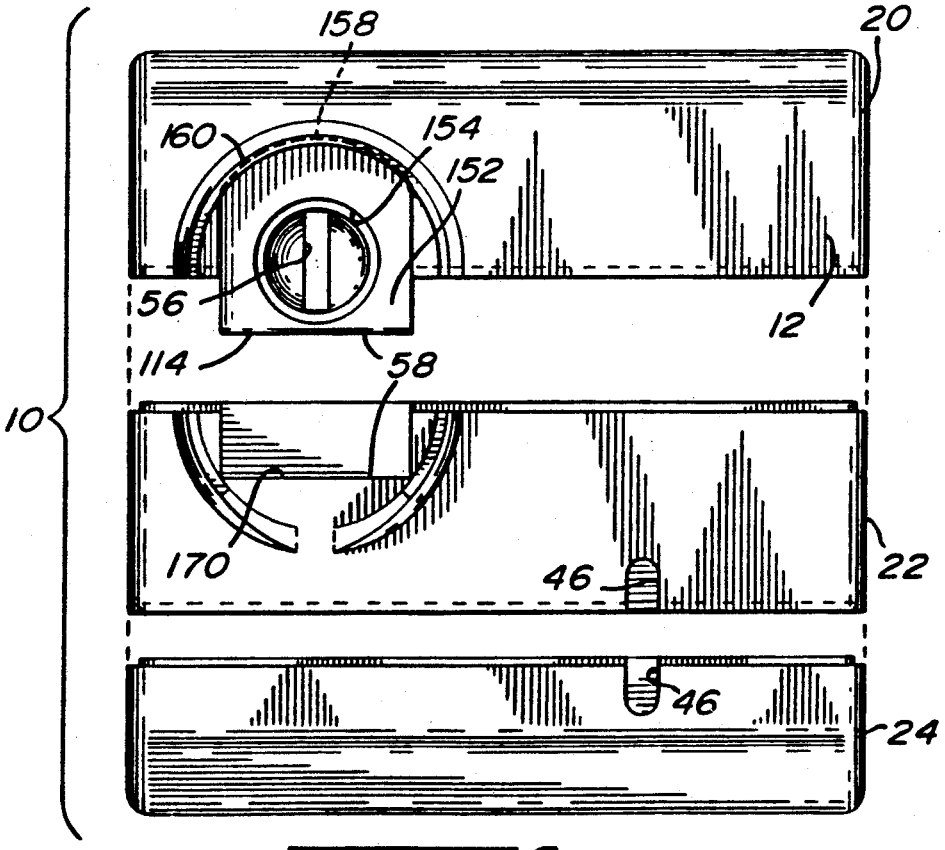
FIG. 4 is an exploded view of the housing of the locking device looking at the front face thereof.
Figure 6:
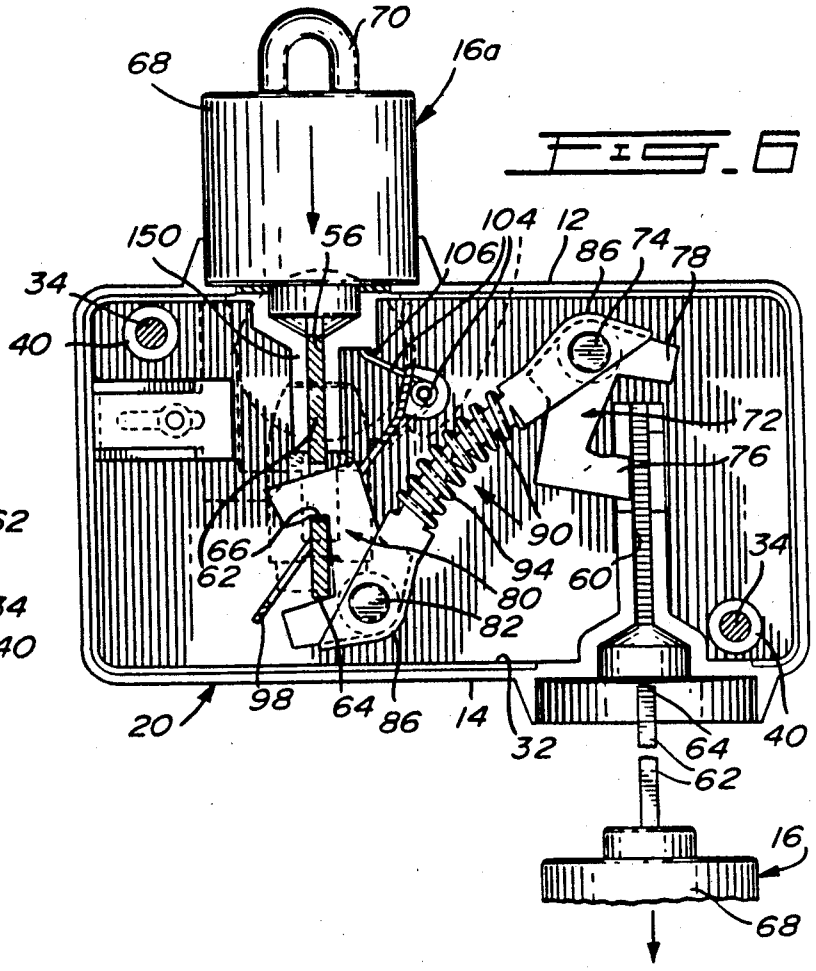
FIG. 6 is a view similar to that of FIG. 5 but showing the mechanism in its second state.
Figure 5:
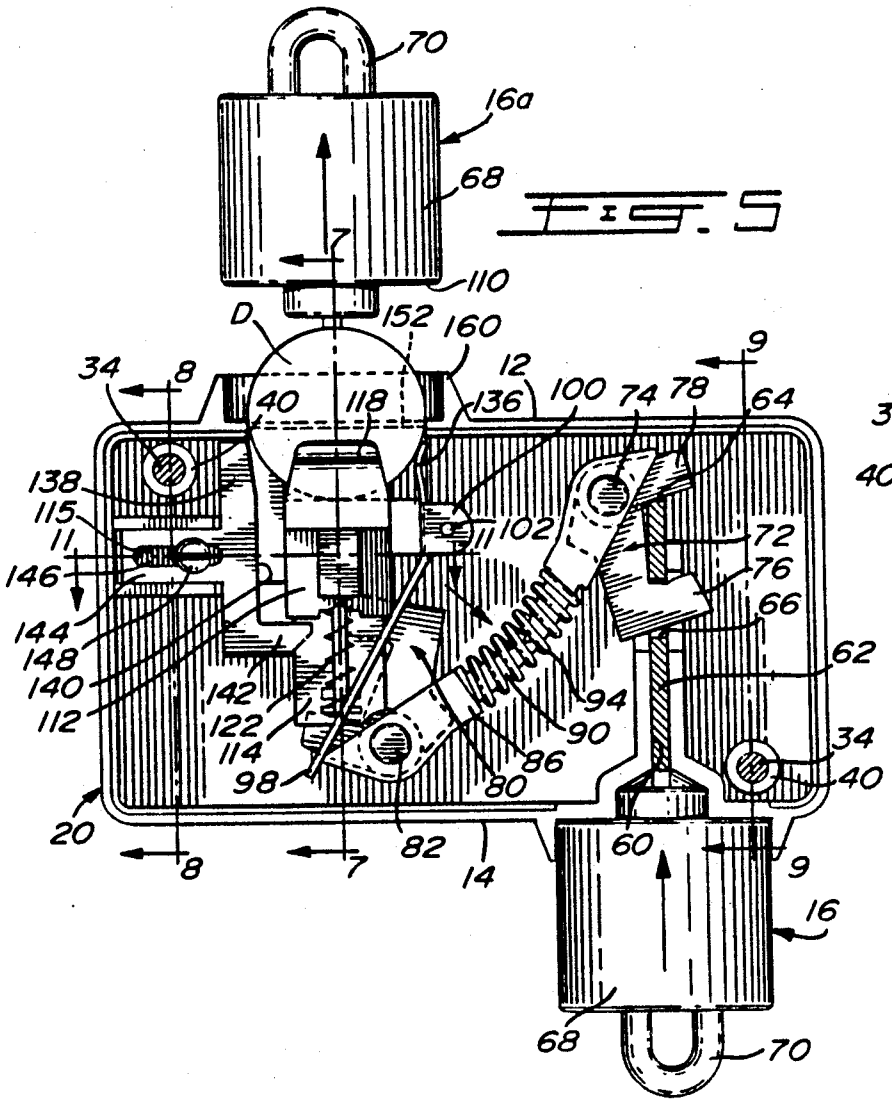
FIG. 5 is a plan view partly in section looking through the bottom of the top part of the housing and taken along line 5—5 of FIG. 3, this view showing the locking mechanism in its first state.

FIG. 4 shows the key slot 56 formed at the front face 12 of the housing 10. Adjacent said key slot is coin-receiving cavity 58 (see also FIG. 7). FIGS. 5, 6, and 10 show the key slot 60 opening at the back face 14 of the housing 10.

Each key 16 comprises a flat key shaft 62 having a free end 64 and a through opening 66 at a predetermined distance from the free end 64. Each key has a key head 68 fixed to the other end of the key shaft and of generally cylindrical shape, laterally protruding from all sides of the key shaft. Each key 16 can be received into either one of the key slots 56, 60. The key head has a U-shape element 70 fixed thereto and which is connected to the last link of the chain 18. Each key slot 56, 60 has a rectangular flat cross-sectional shape to receive, with a sliding fit, the key shaft 62.

Referring to FIGS. 5 and 6, the back key slot 60 is provided at the inner end thereof with a C-shape locking member 72 pivoted on a shaft 74 for pivotal movement across the key slot 60 between a key-locking or retaining position in which the inner leg 76 of locking member 72 engages hole 66 of the key shaft 62, and a release position, as shown in FIG. 6, in which this inner leg clears the key shaft hole 66 and the key slot 60, so that the key 16 may be released.

C-shaped locking member 72 has an outer leg 78, which is in the path of the key slot 60 and which, when pushed by the free end 64 of the key shaft 62, causes pivotal movement of the C-shaped locking member 72 from a key-releasing position to a key-locking position in which the inner leg 76 again engages the hole 66 of the key shaft 62.

A similar arrangement is provided for the front key slot 56. More particularly, a C-shaped locking member 80 is pivoted on a transverse pivotal pin 82 for movement between a key-retaining position in which the inner leg of locking member 80 extends through the hole 66 of the key shaft 62 of key 16*a*, as shown in FIG. 6, and a key-releasing position in which the inner leg releases the key to allow withdrawal of the key 16*a* from the front key slot 56. An interconnecting movement reversing mechanism is provided between the two locking members 72 and 80. A cap 86 is integral with and formed on each locking member 72, 80 around its pivot pin 74, 82 and each cap has an extension 90, of reduced cross-sectional dimensions inserted within the opposite ends of a compression coil spring 94, which abuts against the oppositely-facing steps defined between the ends of the caps 86 and their extensions 90. The spring 94 is in compressed state. The system forms a toggle lever mechanism and has two states, namely: a state as shown in FIG. 5, wherein the front C-shaped locking member 80 is in key-releasing position, while the back locking member 72 is in key-retaining position, the other state being shown in FIG. 6, wherein the positions are inverted, namely: the locking member 72 is in key-releasing position, which the front locking member 80 is in key-locking and retaining position. In both states, the limit positions of both C-Shaped locking members take place when the inner leg of one member fully engages the hole of the inserted key. The front locking member 80 has its outer leg in the path of the key shaft 62, when in key-releasing position, so that insertion of the key 16A within its front key slot will abut against the outer leg and cause pivoting movement of the locking member 80 to its key-retaining position and inverse pivotal movement of the back locking member 72 to its key-releasing position.

A holder mechanism is provided, which is associated with the front key slot 56 to hold the two C-shaped locking members 72, 80 in their state shown in FIG. 5, that is in the position in which the back key 16 is retained by the back locking member 72, while the front locking member 80 is in key-releasing position. This holding mechanism consists of the flat open frame 98, which has inturned ears 100 pivoted on a pivot pin 102 carried by the housing top part 20, the frame 98 pivotable between a holding position, as shown in FIG. 5, in which it surrounds the outer leg of the front locking member 80 to retain the same in key-releasing position, and a clearing position, as shown in FIG. 6 in which the frame 98 is pivoted away from the locking member 80 to permit free pivoting movement of the same. A coil spring 104 is coiled around the pivot pin 102 and has one end engaging the opening formed by the frame 98, which its other end engages a step 106 of the housing top part 20, as shown in FIG. 6. This coil spring 104 is biased to always pivot frame 98 into its holding position, as shown in FIG. 5.

The frame 98 is pivoted to its clearing position by means of a coin D which has to be inserted into coin-receiving cavity or slot 58 formed adjacent the front key slot 56 and in register with the inner face 110 of the key head 68 of the key 16A when the key shaft 62 of said key is inserted in the front key slot 56.

Figure 12:
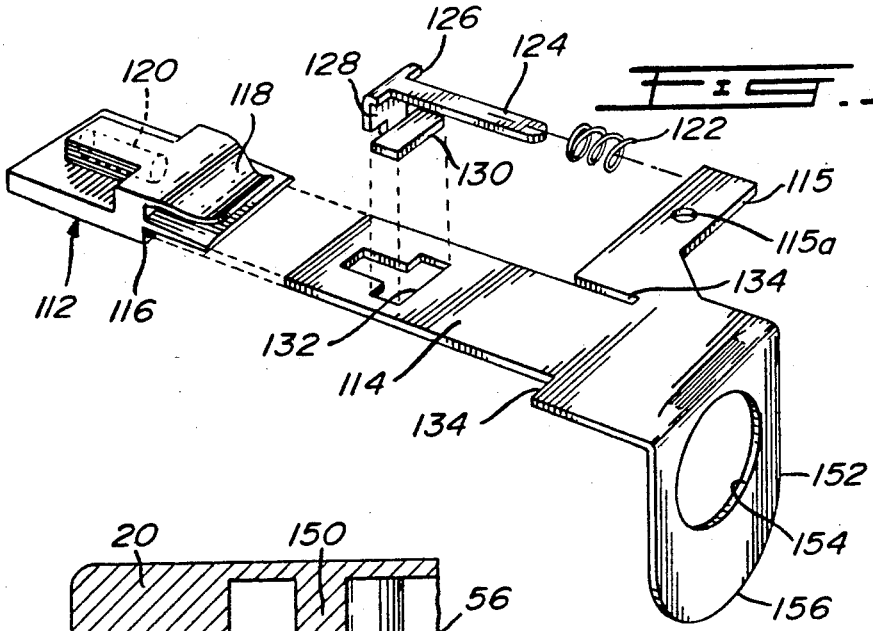
FIG. 12 is an exploded perspective view of the coin-receiving and retaining mechanism.

Referring to FIGS. 5, 7, and 12, there is shown a coin holder 112 mounted in coin slot 58 and which is in the form of a slide arranged for reciprocating movement along a guide strip 114. The coin holder 112 has lateral guideways 116 engaging the sides of the guide strip 114 and is provided at its top with resilient leaf 118 to receive the edge of a coin D and retain the same.

The coin holder 112 has a blind bore 120 opening at its back and receiving one end of a compression coil spring 122, which in inserted around a finger 124, so that the other end of the coil spring abuts against a step 126 formed by a head portion 128 of the finger 124. This head portion has a rectangular flange 130 of a size to enter the cross-portion of a T-shaped hole 132 made in the guide strip 114. The restricted end of head 128 is pushed by the coiled spring 122 against the end of the T-shaped hole 132, and the coin holder 112 is pushed by the coil spring to its limit outer position, wherein it abuts against steps 134 of guide strip 114.

Figure 11:
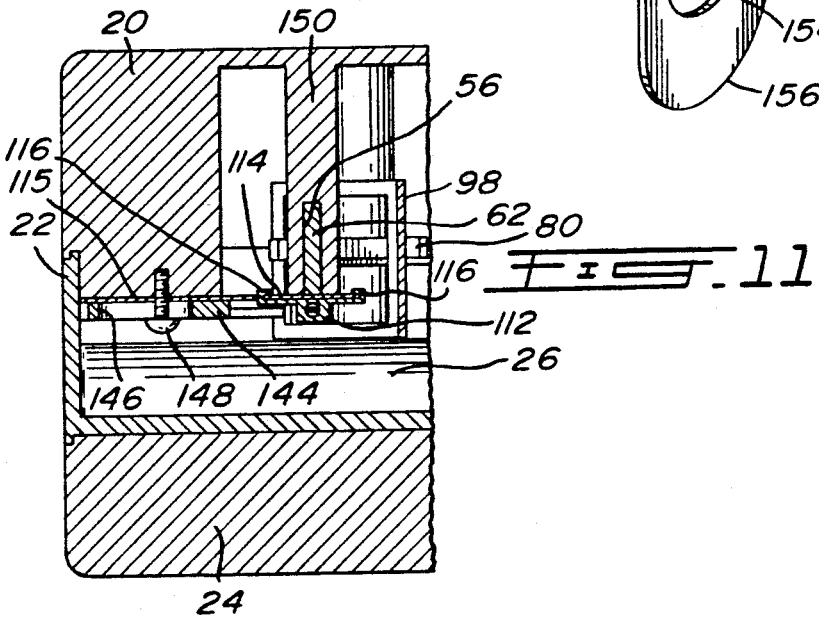
FIG. 11 is a partial section taken along 11—11 of FIG. 5.

In this position, the coil holder 112 is near the front face 12 of the housing ready to receive a coin D which, when inserted, partially protrudes from the housing front face 12, as clearly shown in FIG. 5. The coin is fully inserted within the housing by head 68 of the key 16A when the same is fully inserted within its key slot. Upon coin insertion, a feeler arm 136, integral with holding frame 98 and projecting away from said frame towards the front face 12, comes in engagement with the coin to cause pivoting of the frame to its locking member clearing position. The coin is prevented from lateral displacement under the action of the feeler arm 136 by a guide member 138, which is disposed diametrically opposite the feeler arm 136 with respect to the coin D; the coin slides on the guiding surface 140 of member 138. The inner end of guide 138 is provided with a right-angle leg 142, which serves as a stop for the coin holder 112 being in the path of the same, thereby limiting inward movement of said coin holder. The guide 138 is secured to the top housing part 20 in such a manner that it can be laterally adjusted towards or away from the coin feeler arm 136 for proper operation of the holding frame 98. More particularly, guide 138 has a lateral arm 144 provided with an elongated hole 146 through which extends a bolt 148 which is screwed within the housing top part 20 (see FIGS. 5 and 11). FIG. 11 also shows that the front key slot 56 is formed as a channel at the end of an extension 150 integral with housing top part 20. This key slot is closed by the guide strip 114 and the latter is maintained in position by being provided with a lateral arm 115 located under arm 144 and having a hole 115*a* for bolt 148. Strip 114 also has at its outer end an inturned right angular flange 152, which surrounds the opening of the front key slot 56 at the front face 12 of the housing 10, flange 152 having a hole 154 for uncovering the key slot 56, the flange 152 having a rounded edge 156 which fits within a partly-circular groove 158 formed at the junction of the housing front face 12 with an annular ledge 160 protruding from the housing top face 12 and adapted to receive the key head 68.

FIG. 4 shows clearly the flange 152 in position within the ledge 160 with its hole 154 surrounding key slot 56. The coin slot 58 is formed by the spacing between the guide strip 114 and the corresponding edge 170 of the intermediate housing part 22, this edge being spaced from the guide strip 114 a distance equivalent to the thickness of a coin D when the two housing parts 20 and 22 are secured one to the other.

Referring to FIG. 10, it is seen that the pivot pin 74 of the back locking member 72 extends on both sides of said locking member 72 and is slidably fitted in corresponding blind bores made in cylindrical post 172, 174 extending within and secured to the housing top part 20 and intermediate part 22, respectively, the blind bores made in the post 172, 174 opening at the junction between the two housing parts. The same arrangement is provided for the pivot pin 82 of the front locking member 80. This enables the mechanism to be easily taken apart for servicing.

The locking device of the invention is used as follows. Referring to FIGS. 1 and 2, there is shown a series of nested carts A which are interlocked by means of the key 16 attached to the housing 10 of a back or left-hand cart engaging the back key slot 60 of the housing 10 of the next front or right-hand cart A. The carts are retained in the intended storage area by having the backmost chain attached to a wall or the like fixed structure. Therefore, for all the carts, the key 16 is retained in the back key slot because the back C-shaped locking lever 72 is in the key-retaining position shown in FIG. 5. When a user wants to release the frontmost cart of the row of carts, he simply inserts a coin D within the coil holder 112 and then inserts the key which is suspended from the chain 18 of the cart into the front key slot 56, thereby pushing the coin within the housing and causing the feeler arm 136 to pivot outwardly, thereby to cause the holding frame 98 to clear the locking member 80. Further coin insertion and key shaft insertion will result in the pivoting of the front locking member 80 to thereby retain the front key 16A to the housing and simultaneously release the back key 16 from the housing, whereby the cart can be released and used. During the time the cart is used, the coin D remains trapped within the housing 10 and the user has to return the cart to the storage area and insert the key freely suspended from the last cart into the back key slot 60 to cause release of the key 16A and locking of the key 16. Upon release of key 16A, the coin holder 112 is pushed outwardly by means of the coil spring 122, whereby the coin becomes accessible to the user for retrieval. It follows that proper operation of the system is not dependent on the length of the chain 18. It is sufficient to adjust this length so as to keep the chain sufficiently taut for the interconnected carts. Also, during the entire use of the cart, the key 16A is retained in the housing 10, whereby accidents are prevented and the key cannot be used in the parking lot to unlock another stranded cart to get the coin off the locking means of this stranded cart.

We claim:

1. A locking device for interlocking a first and a second cart, comprising a first and a second key attachable to said first and second arts, respectively, a housing attachable to said first cart and having a first and a second key slot for receiving first and second keys, respectively, a two-state locking mechanism mounted in said housing and including a first and a second locking member associated with said first and said second key slots and each movable from a key-releasing position to a key-locking position upon key insertion in the associated slot, and locking members inter-connecting and position inverting means interconnecting said two locking members, said first and second locking members being in key-locking and key-releasing position, respectively, in the first state of said locking mechanism and in key-releasing position and in key-locking position, respectively, in the second state of said locking mechanism, whereby with said second key locked within said second key slot by said second locking member, insertion of said first key within said first key slot causes locking of said first key to said housing and release of said second key from said housing, further including a coin-receiving cavity in said housing, a coin feeler detecting the presence or absence of the coin in said cavity, a retainer movably mounted in said housing and controlled by said feeler for retaining said first locking member in said key-releasing position upon said feeler detecting the absence of a coin in said cavity and for freeing said first locking member for movement to said key-locking position upon said feeler detecting the presence of a coin in said cavity, and wherein said keys have identical key shafts capable of actuating either one of said locking members when inserted in the respective key slots.

2. An interlocking device as defined in claim 1, wherein said first key is attached to said housing by a first flexible link while said second key is attached to a housing attachable to said second cart by a second flexible link.

3. An interlocking device as defined in claim 1, wherein each key includes a head laterally protruding from its key shaft and said cavity is located adjacent said first key slot and opens opposite the key head of a key inserted within said first key slot, whereby a coin partially inserted within said cavity is fully pushed thereinto upon key insertion into said first key slot, and is concealed and retained by said key head.

4. An interlocking device as defined in claim 1, wherein each key has a key shaft with a free end and an opening spaced from said free end and each locking member is C-shaped and is pivoted in said housing in a position in which a first leg of said C is in the path of said key shaft when inserted into said slot, while a second leg of said C clears said path, the free end of said key, when pushed against said first leg, causing pivoting of said C-shaped locking member to a second position, wherein said second leg enters said opening and locks said key to said housing.

5. An interlocking device as defined in claim 4, wherein said interconnecting and position-inverting means include spring-biased toggle levers, respectively, fixed to said C-shaped locking members and causing pivoting of one locking member in one direction and retention of the latter in a new position upon pivoting of the other locking member in the opposite direction.

6. An interlocking device as defined in claim 2, further including shock-absorbing means for the flexible link attaching said first key to said housing.

7. An interlocking device as defined in claim 6, wherein said housing has a front face and includes a through-bore spaced from and parallel to said front face for receiving the handle bar of a cart; means to fix said housing to said handle bar; said shock absorbing means including an elongated ring in said through-bore for surrounding said handle bar, said ring transversely shiftable in said through-bore; a rubber-like shim inserted between said handle bar and said ring opposite said front face; said link attached to said ring and issuing from said housing through said front face.

8. An interlocking device as defined in claim 1, wherein said housing is made in three parts, namely: a top part, an intermediate part and a bottom part, said bottom and intermediate parts providing registering channels for receiving and surrounding the handle bar of a cart; first fastener means to fix said intermediate and bottom parts together to secure said two parts to said handle, both said key slots being made in said top part, said locking levers also carried by said top part and further including second fastener means to secure said top part to said intermediate and bottom parts.

9. An interlocking device as defined in claim 2, further including a guide strip extending within said housing adjacent to and parallel with said first key slot, a coin-receiving and retaining holder. In the form of a slide, guided by said guide strip in said coin cavity for movement between an inner and an outer limit position, spring means urging said slide to said outer limit position in which a coin inserted into said holder will partly protrude from the housing, said coin feeler being a lever pivoted in said housing to engage and be pivoted by one side of a coin in said holder; said retainer fixed to and pivoting with said lever; and further including a coin guide member engageable with the diametrically-opposite side of the coin in said holder, said coin guide member adjustably secured to said housing for adjusting the distance between said lever and said coin guide member.

10. An interlocking device as defined in claim 9, further a lateral arm depending from said coin guide member and serving as a stop for said coin holder slide in the inner limit position of the latter.

11. A locking device for interlocking a first and a second cart, comprising a first and a second key attachable to said first and second carts, respectively, a housing attachable to said first cart and having a first and a second key slot for receiving said first and second keys, respectively, a two-state locking mechanism mounted in said housing and including a first and a second locking member associated with said first and said second key slots and each movable from a key-releasing position to a key-locking position upon key insertion in the associated slot, and locking members interconnecting and position-inverting means interconnecting said two locking members, said first and second locking members being in key-locking and key-releasing position, respectively, in the first state of said locking mechanism and in key-releasing position and in key-locking position, respectively, in the second state of said locking mechanism, whereby with said second key locked within said second key slot by said second locking member, insertion of said first key within said first key slot causes locking of said first key to said housing and release of said second key from said housing, further including a coin-receiving cavity in said housing, a coin feeler detecting the presence or absence of a coin in said cavity, a retainer movably mounted in said housing and controlled by said feeler for retaining said first locking member in said key-releasing position upon said feeler detecting the absence of a coin in said cavity and for freeing said first locking member for movement to said key-locking position upon said feeler detecting the presence of a coin in said cavity, each key including a key shaft and a head laterally protruding from said key shaft and said cavity being located adjacent said first key slot and opening opposite the key head of a key inserted within said first key slot, whereby a coin partially inserted within said cavity is fully pushed thereinto upon key insertion into said first key slot, and is concealed and retained by said key head, and wherein said housing has first and second walls which are oppositely facing, said first and second key slots being made in said first and second walls, respectively.

12. An interlocking device as defined in claim 11, wherein the key shaft of each key has a free end and an opening spaced from said free end and each locking member is C-shaped and is pivoted in said housing in a position in which a first leg of said C is in the path of said key shaft when inserted into said key slot, while the second leg of said C clears said path, the free end of said key, when pushed against said first leg, causing pivoting of said C-shaped locking member to a second position, wherein said second leg enters said opening and locks said key to said housing.

13. An interlocking device as defined in claim 11, wherein said interconnecting and position-inverting means include spring-biased toggle levers, respectively, fixed to said C-shaped locking members and causing pivoting of one locking member in one direction and retention of the latter in a new position upon pivoting of the other locking member in the opposite direction.

* * * * *